US008172624B2

(12) United States Patent
Tiberio, Jr.

(10) Patent No.: US 8,172,624 B2
(45) Date of Patent: May 8, 2012

(54) WIRING DEVICE ASSEMBLY WITH CONTACT STABILIZING STRUCTURE

(75) Inventor: Patrick J. Tiberio, Jr., Shelton, CT (US)

(73) Assignee: Hubbell Incorporated, Shelton, CT (US)

( * ) Notice: Subject to any disclaimer, the term of this patent is extended or adjusted under 35 U.S.C. 154(b) by 77 days.

(21) Appl. No.: 12/314,248

(22) Filed: Dec. 5, 2008

(65) Prior Publication Data

US 2010/0144212 A1 Jun. 10, 2010

(51) Int. Cl.
*H01R 13/40* (2006.01)

(52) U.S. Cl. ..... 439/733.1

(58) Field of Classification Search ..... 439/733.1, 439/752, 595, 347, 733
See application file for complete search history.

(56) References Cited

U.S. PATENT DOCUMENTS 2,125,485 A * 8/1938 Caldwell ..... 439/469
3,656,093 A * 4/1972 Kinkaid ..... 439/872
4,379,611 A * 4/1983 Foege et al. ..... 439/747
4,408,824 A * 10/1983 Weidler ..... 439/398
4,784,623 A * 11/1988 Beck, Jr. ..... 439/872
4,966,557 A * 10/1990 Barkus et al. ..... 439/246
5,464,356 A * 11/1995 Nebeshima et al. ..... 439/752
5,653,613 A * 8/1997 Shimoda ..... 439/752
6,780,070 B2 * 8/2004 Ishikawa et al. ..... 439/752
6,872,093 B2 * 3/2005 Fukatsu et al. ..... 439/595
6,935,904 B2 * 8/2005 Ishiyama ..... 439/752
7,021,975 B2 * 4/2006 Lappohn ..... 439/733.1

* cited by examiner

*Primary Examiner* — Jean F Duverne

(74) *Attorney, Agent, or Firm* — Kevin M. Barner; Mark S. Bicks; Alfred N. Goodman

(57) ABSTRACT

A wiring device assembly with one or more electrical contacts having respective contact stabilizing assemblies which are operable to rigidly hold the electrical contacts in a device housing. The contact stabilizing assemblies prevent the contacts from becoming displaced within the housing under vibrational, rotational and other stresses. The contact stabilizing assemblies are connected to the electrical contacts and fit in housing channels specifically shaped to accommodate the stabilizing assemblies.

18 Claims, 7 Drawing Sheets

WIRING DEVICE ASSEMBLY WITH CONTACT STABILIZING STRUCTURE

FIELD OF THE INVENTION

The present invention is directed generally to the field of electrical wiring devices. More particularly, the present invention is directed to an electrical receptacle for electrically attaching an electrical device to a power source via a power cord. An exemplary embodiment includes structural elements for stabilizing the electrical contacts within the receptacle housing. The electrical contacts are, thus, held secure during engagement and disengagement of the receptacle and prevented from being displaced, for example, in the lateral direction.

BACKGROUND OF THE INVENTION

Electrical wiring devices, such as those for making detachable electrical connections, often include a female receptacle and a male plug. Both plugs and receptacles, further, often include a non-conductive housing for holding electrically conductive contacts. In particular, the plug housing typically includes one or more male electrical contact that mate with corresponding female electrical contact in the receptacle housing. Regardless of the number of contacts, however, it is important that the interface between the male and female contacts be extremely rigid. For example, in order to maintain a consistent flow of electric current, or power, through the connector interface, the male and female contacts must not be permitted to move with respect to each other and they should be kept in constant contact with each other. However, because such connectors are typically used in conjunction with power cords or other such movable structures, the connectors are often moved, which increases the probability of disturbing the interface between the male and female contacts.

Some related art connectors include cylindrical plug and receptacle housings each of which houses one or more male and female contact terminals, respectively. The female contact terminals include a receiving part that allows the male contact terminal in the plug housing to be inserted therein to form a tight fit. The female contact terminal is attached to the inside surface of the receptacle housing and is also electrically attached to an electrical conducting element, such as an electrical power wire. Conventional connectors are problematic, however, because to ensure that the two housings stay connected or, more importantly, that the male and female contact members form a sufficient electrical contact, the housings are often provided with an interlocking mechanism, such as complementary threads. One of the housings is then threaded onto the other housing with a twisting motion, which can potentially disturb the orientation of the contact terminals within the housings. Forces other than the manual twisting force generated from connecting the two housings can also result in one or more of the contacts becoming disoriented. For example, vibrational or other environmental forces can cause inadvertent disconnection of the contacts.

Therefore, there is a need for an electrical connector that is resistant to vibrational and rotational forces to prevent the unintentional disconnection of the electrical connector or otherwise compromise the stability of the interface between the electrical contacts.

The present invention addresses the shortcomings and limitations in the aforementioned related art attempts at preventing unintentional disconnection of an electrical connector by providing a high strength, vibration resistant, and anti-rotational wiring device assembly.

SUMMARY OF THE INVENTION

Illustrative, non-limiting embodiments of the present invention overcome the aforementioned and other disadvantages associated with related art electrical connectors. Also, the present invention is not required to overcome the disadvantages described above and an illustrative non-limiting embodiment of the present invention may not overcome any of the problems described above.

The present invention generally relates to an electrical connector used, for example, to connect an electrical device to a power source via an electrical power cord. More particularly, an exemplary embodiment of the present invention includes structural elements for stabilizing the electrical contacts within a receptacle housing. Accordingly, the contacts within the housing are held secure during engagement and disengagement of the receptacle and prevented from being displaced, for example, in the lateral direction with respect to the contacts. With respect to at least one embodiment, an integral ninety-degree flange extension is provided on the sides of the contact structure. The flange extensions engage respective channel portions in the receptacle housing and are, thus, prevented from rotating or moving laterally with respect to the contact assemblies as the receptacle housing is mated with a corresponding plug assembly and corresponding contact portions in the mating plug come into contact with the contacts in the receptacle housing.

According to one embodiment an electrical receptacle assembly is provided with a housing having one or more channels and at least one electrically conductive contact member disposed in respective channels in the housing. The contact member has an integral contact stabilization member for rigidly retaining the electrical contact member in its respective channel in the housing.

According to yet another embodiment, an electrically conductive contact member is provided that is disposed within an electrical receptacle. The contact member includes a conductor attachment element, a mating contact element and a contact stabilizing element. The contact element has first and second grasping members for electrically connecting the contact element to another mating contact element from another connector, and the stabilizing element is integral with at least one of the first and second grasping members of the mating contact element.

In accordance with yet another embodiment of the invention, a method of manufacturing an electric receptacle is provided in which the method includes providing a non-conductive housing having at least one opening on each of two ends thereof, placing an electrically conductive contact element in a respective channel within the housing and placing a contact stabilizing member in a respective channel within the housing. Further, the respective channel for the contact stabilizing member is substantially the same shape as the contact stabilizing member.

As used herein "substantially", "generally", and other words of degree, are used as a relative modifier intended to indicate permissible variation from the characteristic so modified. It is not intended to be limited to the absolute value or characteristic which it modifies but rather approaching or approximating such a physical or functional characteristic.

BRIEF DESCRIPTION OF THE DRAWINGS

The aspects of the present invention will become more readily apparent by describing in detail illustrative, non-limiting embodiments thereof with reference to the accompanying drawings, wherein like numbers designate like objects, and in which.

DETAILED DESCRIPTION OF ILLUSTRATIVE, NON-LIMITING EMBODIMENTS

Exemplary, non-limiting, embodiments of the present invention are discussed in detail below. While specific configurations and dimensions are discussed to provide a clear understanding, it should be understood that the disclosed dimensions and configurations are provided for illustration purposes only. A person skilled in the relevant art will recognize that other dimensions and configurations may be used without departing from the spirit and scope of the invention.

Figure 1A:
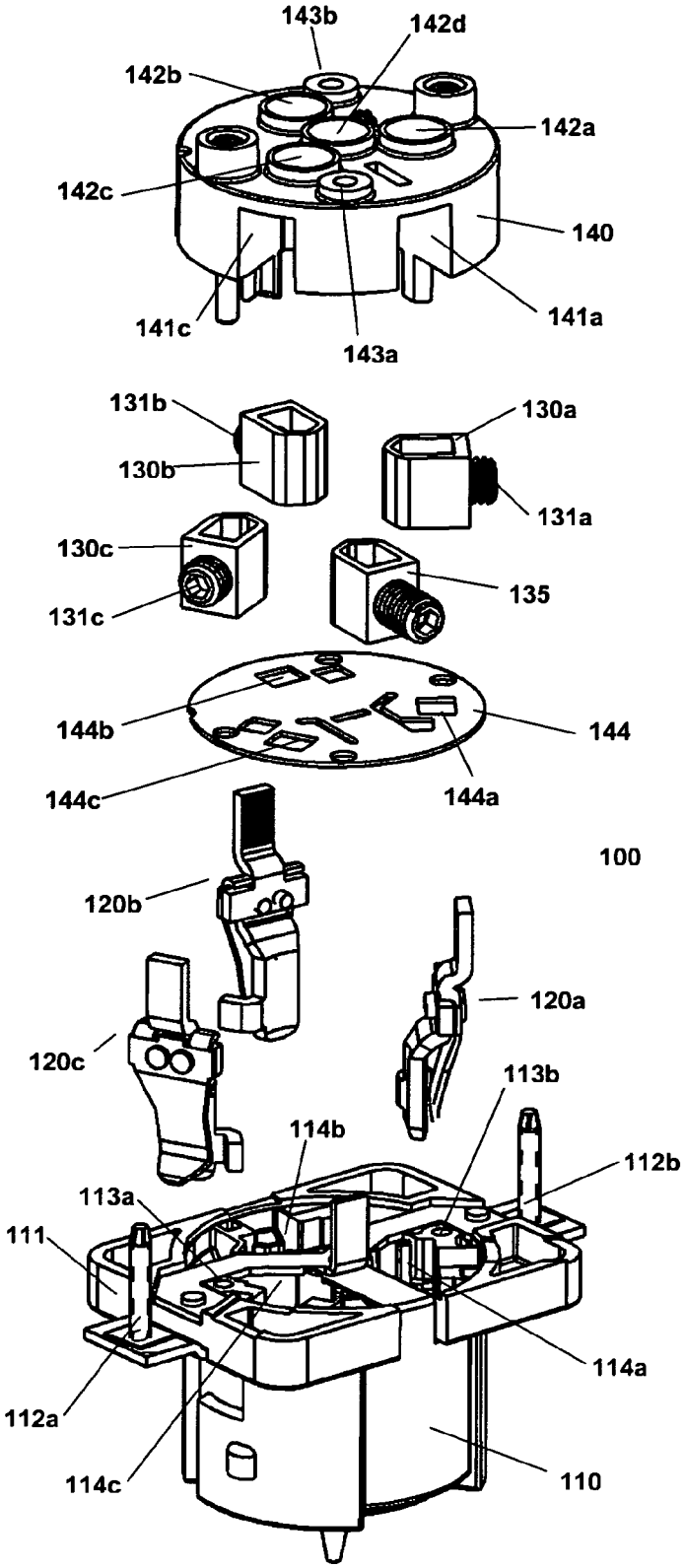
FIG. 1A is an exploded perspective view of a female electrical receptacle having a contact stabilization assembly in accordance with one exemplary embodiment of the present invention.

FIG. 1A illustrates an exemplary embodiment of a wiring device in accordance with the present invention. In particular, the embodiment of FIG. 1A is a female electrical receptacle 100 that includes a main housing 110, three female contact members 120*a*, 120*b* and 120*c*, four corresponding wiring lugs 130*a*, 130*b*, 130*c* and 135, and a rear contact cover 140. Main housing 110 and rear contact cover 140 are made from nonconductive material, such as plastic, in order to maintain electrical isolation of the contact members 120*a*-120*c* and, more importantly, protect anyone who comes into contact with the housing from being shocked, or worse, electrocuted, when current is flowing through the contact members. Main housing 110 includes an integral flange 111 with optional attachment devices 112*a* and 112*b* to attach the main housing 110 to a surface, such as a wall. As will be described in more detail below, main housing 110 also includes one or channels 114*a*, 114*b* and 114*c* for respectively holding the three female contact members 120, 120*b* and 120*c*.

Figure 1B:
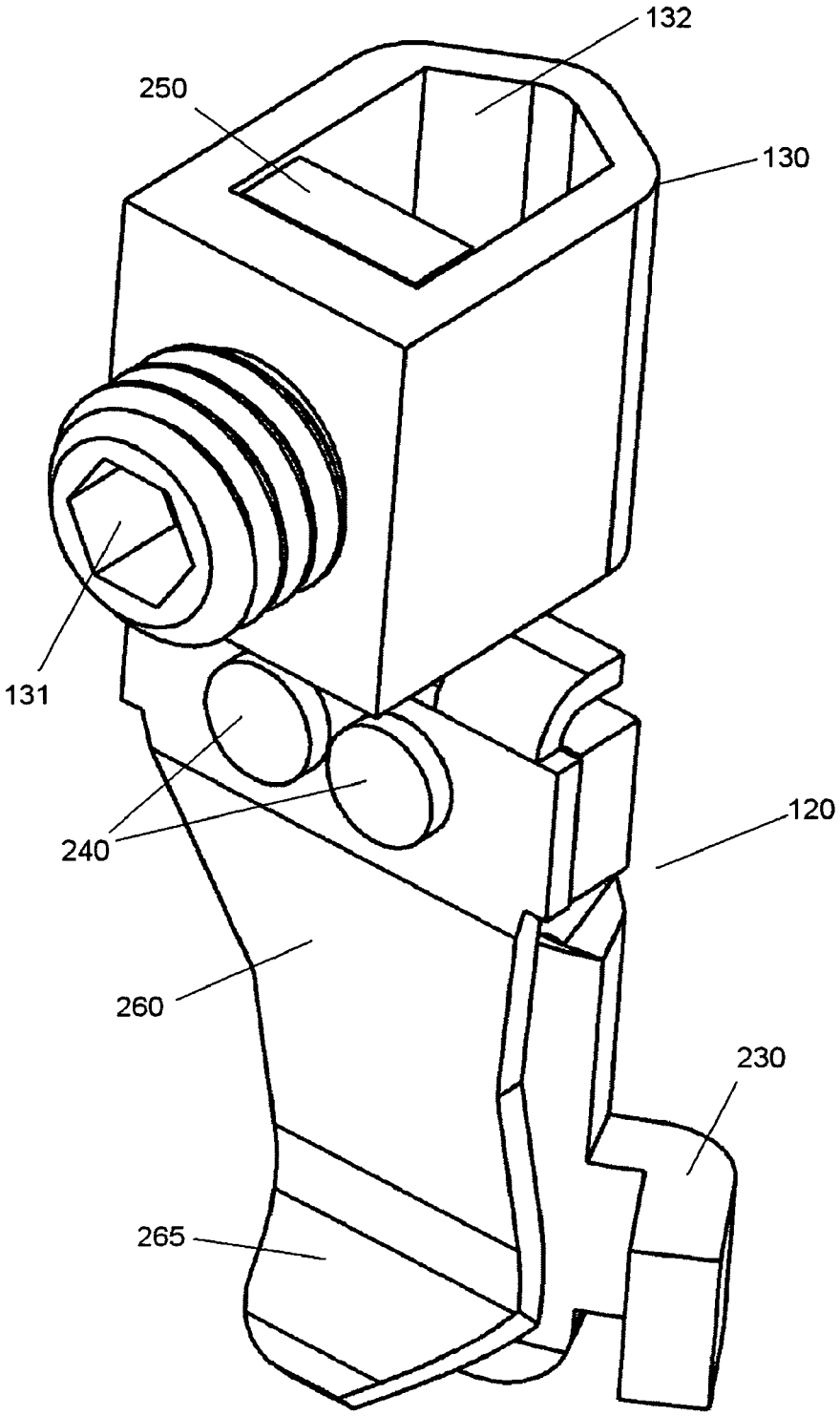
FIG. 1B is close-up perspective view showing how a wire attaches to a female contact member having a contact stabilization assembly in accordance with one exemplary embodiment of the present invention.

Wiring lugs 130*a*-130*c* each corresponds to a respective female contact member, 120*a*-120*c*, and are for securing respective wires to the female contact members. Wiring lug 135 is a ground lug and is for connecting a ground wire to receptacle 100. For example, in accordance with the present embodiment, wires, 300*a*, 300*b* and 300*c*, respectively, shown for example in FIG. 2, as well as ground cable 301, pass through holes 142*a*, 142*b*, 142*c* and 142*d*, respectively, in rear contact cover 140. Typically, the end portion of the respective wires is exposed to the bare conductor and the rest of the wire is insulated using a non-conductive insulating material. The exposed ends of the wires are inserted through holes 142*a*-142*c* and then into the wiring lugs 130*a*-130*c*, in the space between the respective screws 131*a*-131*c* and the rear portion of the respective female contact member, illustrated as space 132 in FIG. 1B. According to this embodiment, the connection of the wires to the wiring lugs 130*a*-130*c* and the female contact members 120*a*-120*c* is performed after the female contact members are inserted into their corresponding channels 114*a*-114*c* in housing 110 and separator disc 144 has been installed.

Channels 114*a*-114*c* in main housing 110 are configured with a tight tolerance, that is, such that the female contact members fit into their respective channels with little or no space left over within the channel. Accordingly, movement of the female contact members is minimized. The front of the contact members 120*a*-120*c* abut respective stop structures within the channels to prevent the contact members from moving any farther in the forward direction, i.e., the same direction in which the contacts were inserted into the channels.

Figure 2:
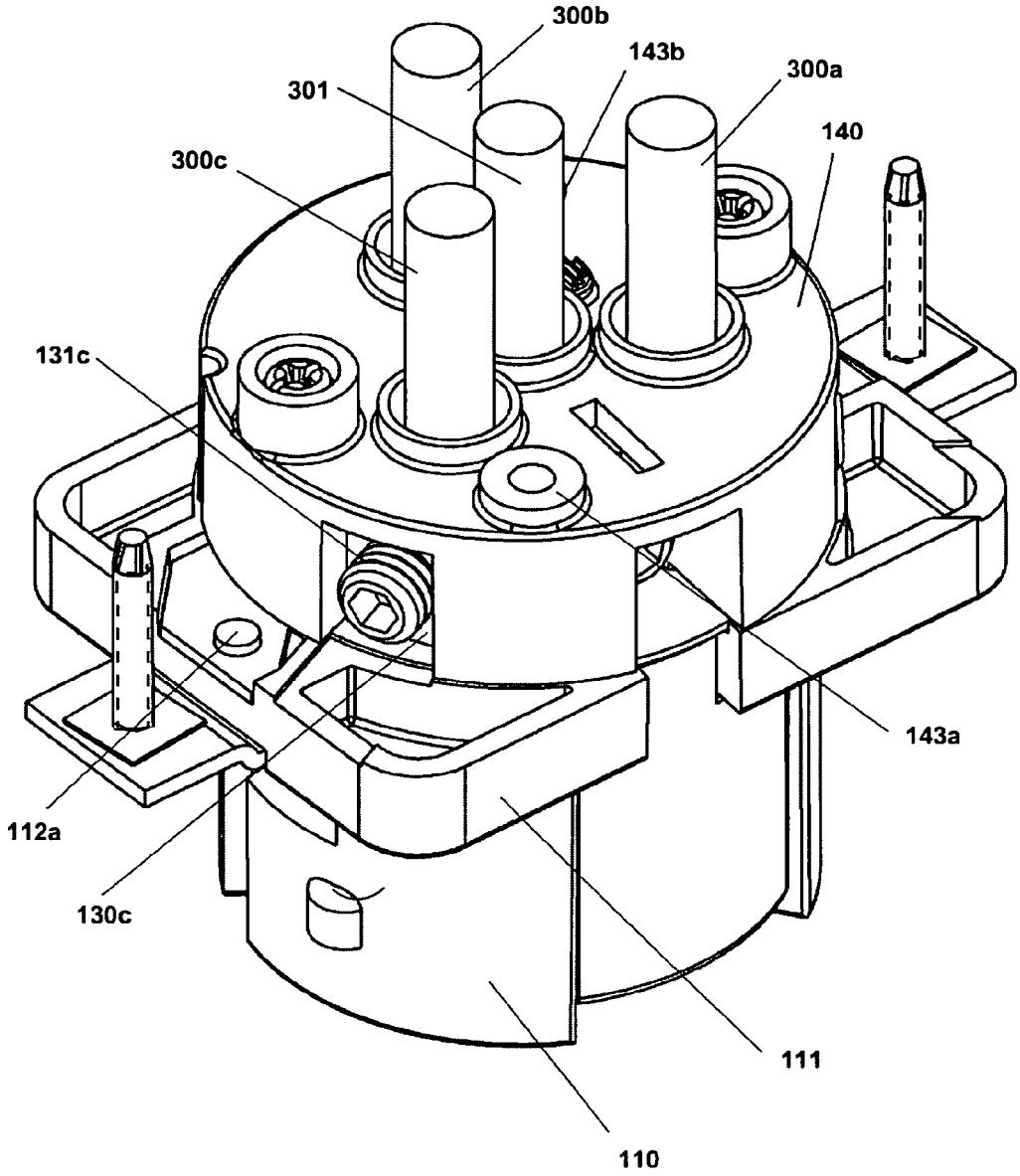
FIG. 2 is a rear perspective view of a female electrical receptacle in accordance with one exemplary embodiment of the present invention.

To prevent movement of the contact members in the rearward direction, i.e., in the opposite direction from which the contact members are inserted into the housing channels, as shown in FIG. 2, rear contact cover 140 is attached to the back of the main housing 110 using suitable fasteners, such as screws, inserted through recessed holes 143*a* and 143*b* in rear contact cover 140 and into corresponding holes 113*a* and 113*b* formed in main housing 110. Within the inside area of rear contact cover 140 rigid, non-conductive, structure is provided which abuts against the rear portion of the female contact members 120*a*-120*c* after the rear contact cover 140 has been attached to the main housing 110.

Figure 3A:
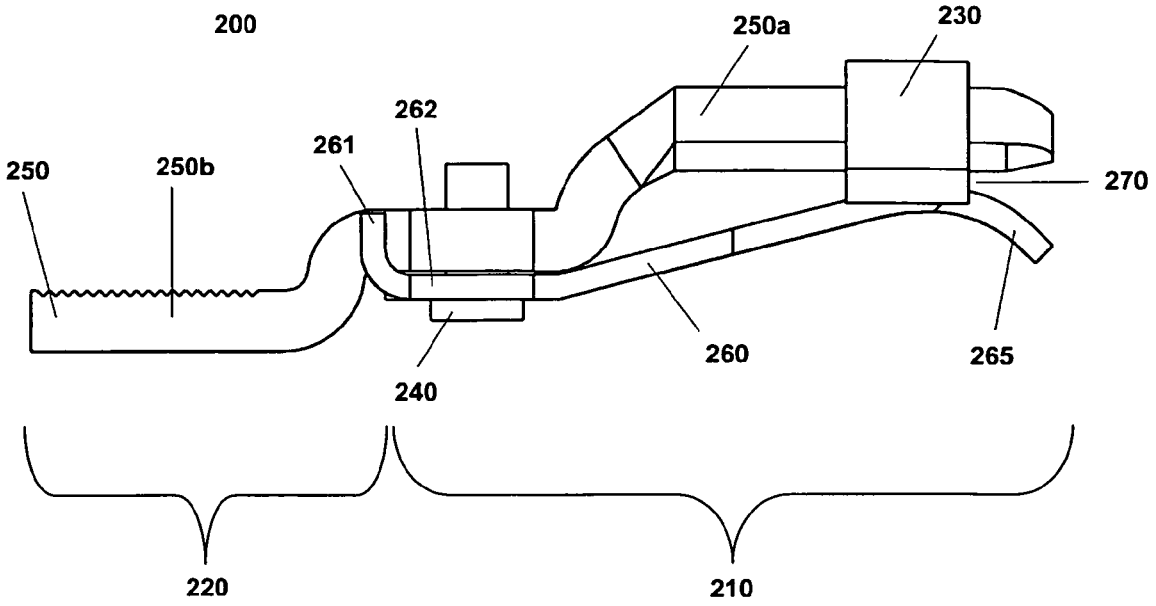
FIG. 3A is a close-up side view of a female contact member having a contact stabilization assembly in accordance with one exemplary embodiment of the present invention.
Figure 3B:
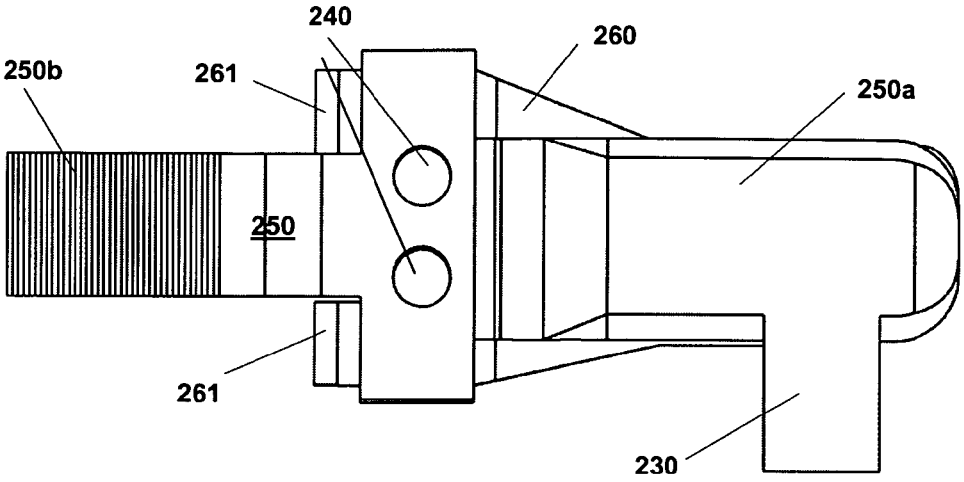
FIG. 3B is a close-up bottom view of a female contact member having a contact stabilization assembly in accordance with one exemplary embodiment of the present invention.
Figure 3C:
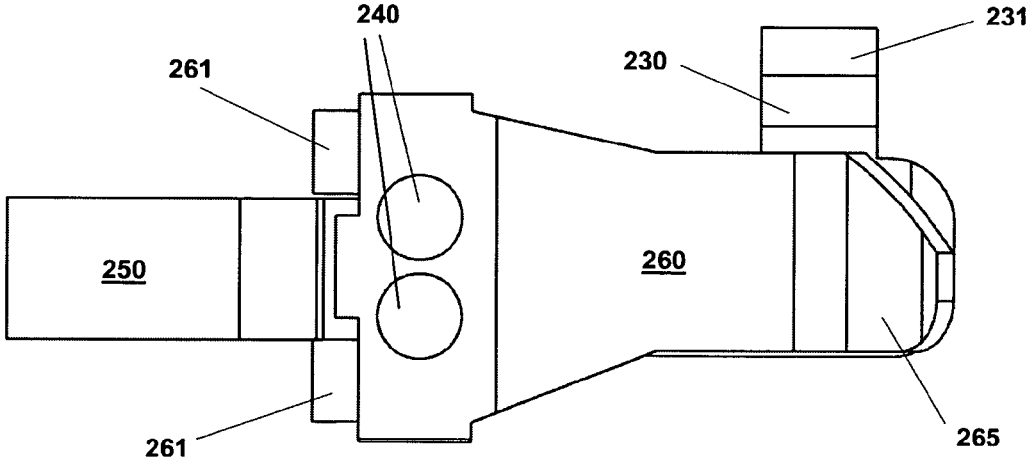
FIG. 3C is a close-up top view of a female contact member having a contact stabilization assembly in accordance with one exemplary embodiment of the present invention.
Figure 3D:
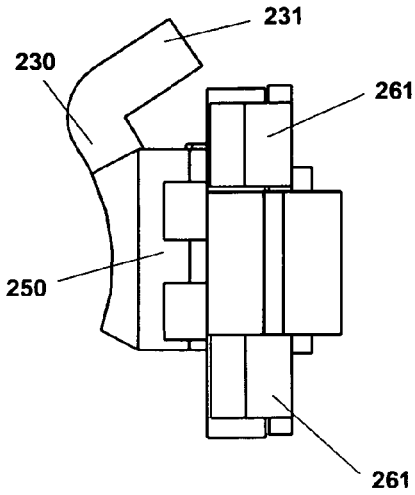
FIG. 3D is a close-up end view of a female contact member having a contact stabilization assembly in accordance with one exemplary embodiment of the present invention.

Additionally, according to the embodiment shown in FIG. 1A, disc 144, made of an electrically insulative, non-conductive, material, is disposed onto the back side of main housing 110. Holes 144*a*-144*c* are provided in disc 144 to permit the conductor attachment section (220 in FIG. 3A) of each contact member 120*a*-120*c*, respectively, to protrude therethrough and into the rear contact cover assembly 140 via lugs 130*a*-130*c*, which receive the conductor attachment section of the respective contact members and are then received, respectively, in channels 141*a*-141*c* in rear contact cover 140. Accordingly, even if the wires 300*a*-300*c* are pulled relative to the housing portions 110 and 140, the female contact members will not be displaced in the rearward direction. If a wire needs to be replaced, the respective screw 131 is loosened to disengage the wire from the corresponding female contact member and the wire is removed. A new wire is then inserted into the space 132 (FIG. 1B) and the screw 131 is tightened to secure the wire to the female contact member.

A contact stabilizing structure in accordance with an exemplary embodiment of the present invention will now be described in reference to FIGS. 3A-3D.

FIGS. 3A-3D show a female contact member with a contact stabilizing element in accordance with an exemplary embodiment of the present invention. In particular, female contact member 200 includes a clamping section 210, a conductor attachment section 220 and a stabilizing element 230. Clamping section 210 of female contact member 200 includes front portion 250*a* of main body portion 250 and a retainer arm 260. Conductor attachment section 220 comprises a flat section 250*b* of main body portion 250 and is long enough to provide sufficient area to attach a wire, for example, by the method discussed above in connection with FIG. 1B.

Main body portion 250 is made of a rigid conductive material, such as copper or some other suitable metal. Retainer arm 260 is also made from a conductive material, for example the same material as main body portion 250, but retainer arm 260 is semi-rigid and permits a small amount of flexing to occur.

According to the present embodiment retainer arm 260 is made of a flat piece of copper having a lip portion 265 that capable of bending slightly outward, away from main body portion 250, and a base 262. Retainer arm 260 is attached to main body portion 250 with a suitable fastening means, such as screws or rivets 240, provided through base 262. Additionally, grasping members 261 are provided on the rear side of retainer arm 260 and straddle section 250*b* of the conductor attachment section 220. As shown clearly in FIGS. 3A and 3B, grasping members 261 are integral portions of retainer arm 260 and are formed to be ninety degrees from base 262.

According to the embodiment of FIGS. 3A-3D, the material used to fashion retainer arm 260 is thinner than the material used to make the main body portion 250. Accordingly, retainer arm 260 will flex outward away from main body portion 250 as a male contact member of a mating male connector (not shown) is inserted into the space 270 shown in FIG. 3A. Also, to ensure good electrical contact between the male contact member and the female contact member, the width of the male contact member is larger than the width of space 270 (FIG. 3A), i.e., the space between the front portion 250*a* of main body portion 250 and a retainer arm 260.

Figure 4A:
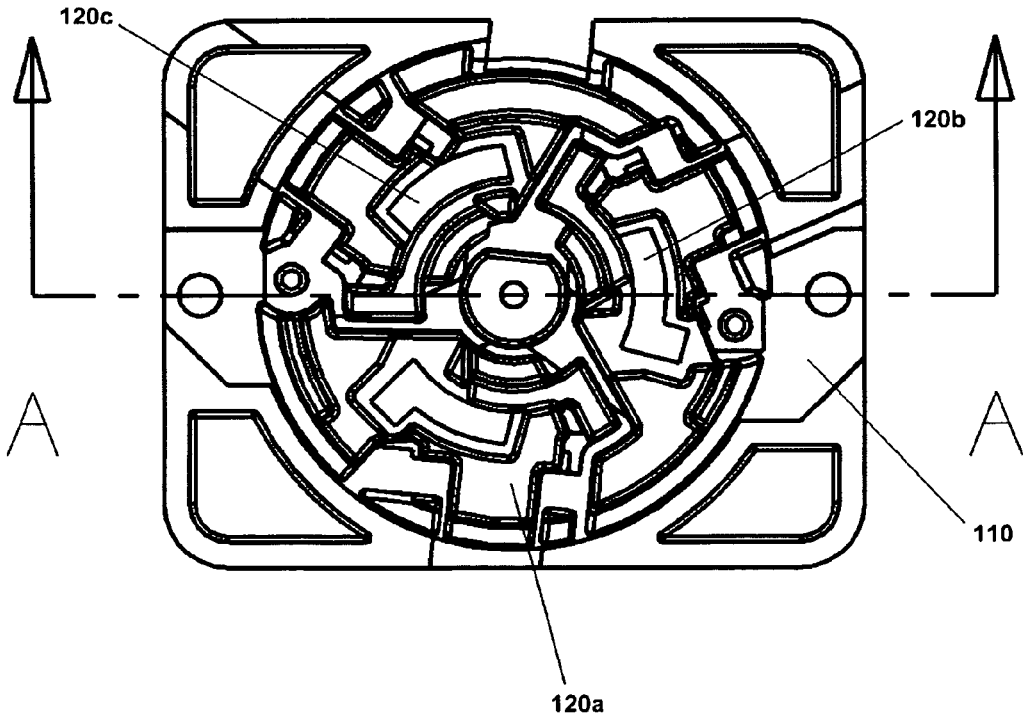
FIG. 4A is a top view of the main body portion of a female electrical receptacle including three female contact members with stabilization assemblies in accordance with one exemplary embodiment of the present invention.
Figure 4B:
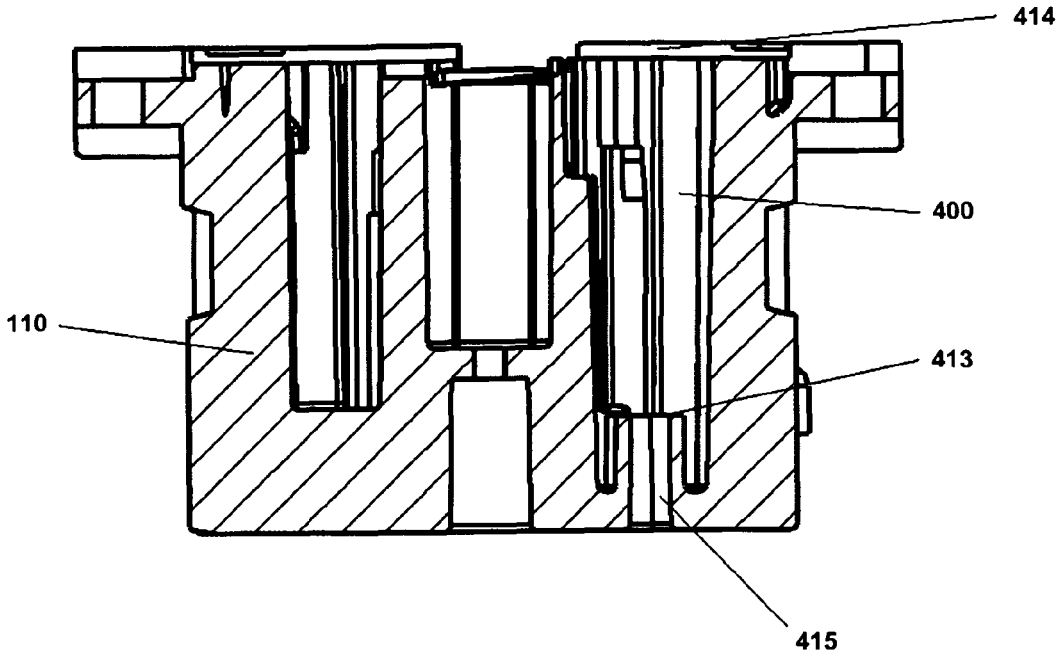
FIG. 4B is a side cutaway view along line A-A of the main body portion of the female electrical receptacle illustrated in FIG. 4A.
Figure 4C:
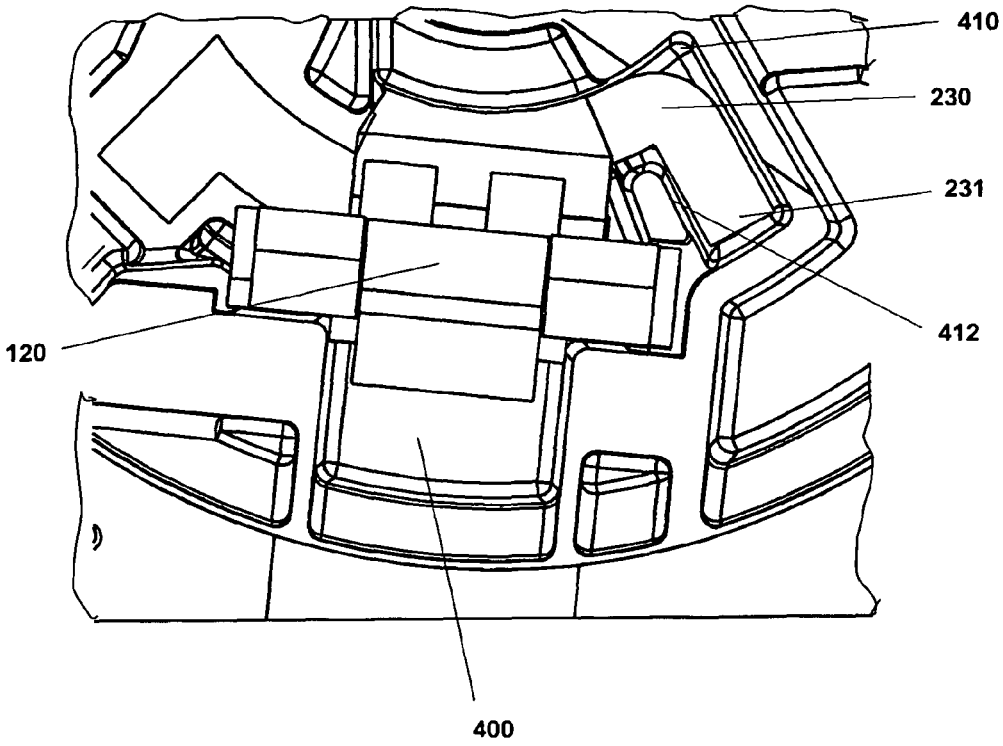
FIG. 4C is a close-up top view of a female contact member with a stabilization assembly inserted into a respective channel of the main body portion of a female electrical receptacle in accordance with one exemplary embodiment of the present invention.

A description of the contact stabilization assembly will now be provided referring to FIGS. 4A-4C. In particular, as shown in accordance with the exemplary embodiment of FIG. 4A, the three female contact members 120*a*, 120*b* and 120*c* are placed into respective channels within main housing 110 of the receptacle. Clamping section 210 (FIG. 3A) of the contact members is slid into its respective channel which is formed such that contact member 120 fits snugly into the channel. According to the present embodiment, the contact members fit snugly into their respective channels and are further held in place with disc 144 (FIG. 1A). As shown more clearly in FIG. 4C, each channel 400 is formed to be substantially the same shape as the outer dimension of the contact member 120. Thus, because the channel is only slightly larger than the outer dimension of the contact member, the contact member is held tightly within the channel.

Further, to prevent any potential rotational movement of the contact member and to further stabilize the female contact member within its corresponding channel, a contact stabilizing element 230 is provided on one or both sides of main body portion 250 (FIG. 3A) of the contact member 120. According to the embodiment shown, contact stabilizing element 230 is formed substantially at a right angle from the side of main body portion 250 and includes end portion 231 which holds the contact member in place in the event rotational forces act on the contact member while it is within channel 400. The part of channel 400 that is labeled 410 in FIG. 4C is formed substantially the same shape as stabilizing element 230 and includes ledge 412. When directional forces are exerted on the contact member, end portion 231 of the stabilizing element 230 pushes against ledge 412 to prevent the contact member from twisting, or otherwise moving in the direction of ledge 412.

FIG. 4B is a cut-away view of the main body portion 110, specifically a view along line A-A from FIG. 4A. As shown in FIG. 4B, channel 400 has an opening 414 at the top of main body portion 110 and is about three-quarters of the length of the length of the main body 110. Seat 413 is at the bottom of channel 400 and provides a stop mechanism for female contact member 120 when it is within channel 400. That is, contact member 120 sits on seat 413 and is prevented from being removed from main body portion 110 other than through opening 414. Opening or slot 415 is provided through main body 110 and goes from the bottom of channel 400, where seat 413 is located through the bottom of the main body portion 110. Male contact members (not shown) are, thus, connected to clamping section 210 (FIG. 3A) of the female contact member 110 through opening 415.

While various aspects of the present invention have been particularly shown and described with reference to the exemplary, non-limiting, embodiments above, it will be understood by those skilled in the art that various additional aspects and embodiments may be contemplated without departing from the spirit and scope of the present invention. For example, a skilled artisan would understand that the contact stabilizing element and its respective channel within the main body portion of the receptacle can be made of various shapes and dimensions. The important feature being that the stabilizing element prevents the contact member from moving within the channel.

It would be understood that a device or method incorporating any of the additional or alternative details mentioned above would fall within the scope of the present invention as determined based upon the claims below and any equivalents thereof.

Other aspects, objects and advantages of the present invention can be obtained from a study of the drawings, the disclosure and the appended claims.

What is claimed is:

1. A wiring device assembly comprising:

a housing having one or more channels; and at least one female electrically conductive contact member disposed within a respective channel in said housing and having an integral contact stabilization member for rigidly retaining said electrical contact member in its respective channel, wherein each female electrically conductive contact member includes a first end that is substantially flat and a second end having a rigid retaining member and a flexible retaining member, wherein the flexible retaining member faces the rigid retaining member and flexes away from the rigid retaining member when a male contact member is inserted between the flexible retaining member and the rigid retaining member.

2. The wiring device assembly claimed in claim 1, wherein at least one of the channels has substantially the same shape as the integral contact stabilization member.

3. The wiring device assembly claimed in claim 2, wherein the integral contact stabilization member is disposed within the channel with substantially the same shape as the integral contact stabilization member.

4. The wiring device assembly claimed in claim 3, wherein the integral contact stabilization member is substantially L-shaped.

5. The wiring device assembly claimed in claim 1, wherein said housing comprises a main body portion and an end cap portion, wherein the main body portion includes the one or more channels for rigidly retaining the at least one contact member and the end cap portion accommodates at least one electrically conductive wiring lug respectively corresponding to each of the at least one contact member.

6. The wiring device assembly claimed in claim 3, wherein said at least one contact member comprises a conductor attachment section for attaching an electrically conductive wire and a contact attachment section for attaching a mating contact member.

7. The wiring device assembly claimed in claim 6, wherein said housing comprises a main body portion and an end cap portion, wherein the main body portion includes the one or more channels for rigidly retaining the contact attachment section of each contact member and the end cap portion holds the conductor attachment section of each contact member and at least one electrically conductive wiring lug respectively corresponding to each contact member.

8. An electrically conductive contact member disposed within an electrical connector, the contact member comprising:

a conductor attachment element;

a mating contact element having first and second grasping members; and a contact stabilizing element formed integrally with at least one of the first and second grasping members of said mating contact element, wherein said contact stabilizing element is shaped to fit within a corresponding channel of a non-conductive housing, the corresponding channel being shaped differently than a channel into which the grasping members fit.

9. The electrically conductive contact member claimed in claim 8, wherein said contact stabilizing element comprises a first portion extending from said mating contact section of the contact member and a second portion formed integrally with said first portion and substantially at a right-angle to said first portion.

10. The electrically conductive contact member claimed in claim 9, wherein the first and second grasping members are joined together at respective ends thereof with a fastening means.

11. The electrically conductive contact member claimed in claim 10, wherein said conductor attachment element is integral with one of the first and second grasping members of said mating contact element.

12. The electrically conductive contact member claimed in claim 11, wherein said conductor attachment element includes a substantially planar section, the first and second grasping members respectively include substantially planar sections and the substantially planar section of said conductor attachment element is disposed in a plane different from at least one of the respective planar sections of the first and second grasping members.

13. The electrically conductive contact member claimed in claim 10, wherein at least one of the first and second grasping members flexes relative to the other grasping member.

14. A wiring device assembly for electrically connecting a power source to an electrical device comprising:

a plug assembly having a plug housing and at least one electrically conductive plug contact member disposed within the plug connector housing and electrically connected to one of the power source and the electrical device; and a receptacle assembly having a receptacle housing and at least one electrically conductive receptacle contact member disposed within the receptacle housing and electrically connected to the other of the power source and the electrical device, wherein each plug and receptacle contact member includes a rigid retaining arm and a flexible retaining arm facing the rigid retaining arm, and wherein at least one of the plug and receptacle contact members includes a contact stabilizing assembly rigidly retaining the contact member in its respective housing and wherein said contact stabilizing assembly extends directly from a side portion of the respective rigid retaining arm.

15. The wiring device assembly claimed in claim 14, wherein the contact stabilizing assembly comprises an integral holding portion disposed in a channel within its respective housing.

16. The wiring device assembly claimed in claim 15, wherein the channel in which the holding portion of the contact stabilizing assembly is disposed has the same shape as the holding portion.

17. The wiring device assembly claimed in claim 16, wherein the holding portion of the contact stabilizing assembly is substantially L-shaped.

18. A wiring device assembly for electrically connecting a power source to an electrical device comprising:

a plug assembly having a plug housing and at least one electrically conductive plug contact member disposed within the plug connector housing; and a receptacle assembly having a receptacle housing and at least one electrically conductive receptacle contact member disposed within the receptacle housing, wherein at least one of the plug and receptacle contact members includes an L-shaped contact stabilizing assembly for retaining the contact member in a respective L-shaped channel within its housing.

* * * * *